United States Patent [19]

Majkrzak et al.

[11] 4,092,484

[45] May 30, 1978

[54] ARRANGEMENT TO PREVENT CORONA DISCHARGE AND ELECTRIC RUPTURE IN HIGH VOLTAGE ELECTRICAL COMPONENTS

[75] Inventors: Charles Peter Majkrzak, Nutley; Vishno Edward Brennan, Glen Ridge, both of N.J.

[73] Assignee: International Telephone & Telegraph Corporation, Nutley, N.J.

[21] Appl. No.: 725,208

[22] Filed: Sep. 22, 1976

[51] Int. Cl.[2] ..... H01F 27/02

[52] U.S. Cl. ..... 174/12 R; 336/94

[58] Field of Search ..... 174/12 R, 12 BH; 336/94, 92

[56] References Cited

U.S. PATENT DOCUMENTS

| | | | |
|---|---|---|---|
| 3,322,883 | 5/1967 | Lusk | 174/12 BH |
| 3,445,580 | 5/1969 | Lusk | 174/12 BH |
| 3,548,070 | 12/1970 | Duenke | 174/12 BH |

FOREIGN PATENT DOCUMENTS

| | | | |
|---|---|---|---|
| 652,960 | 11/1962 | Canada | 174/12 R |
| 844,415 | 8/1960 | United Kingdom | 174/12 R |
| 143,128 | 3/1968 | U.S.S.R. | 174/12 R |

*Primary Examiner*—J. V. Truhe
*Assistant Examiner*—David A. Tone
*Attorney, Agent, or Firm*—John T. O'Halloran; Alfred C. Hill

[57] ABSTRACT

The arrangement includes an enclosed container containing therein high voltage electrical components. A dielectric oil is disposed in and completely fills the container. A volume/pressure compensator is fastened to the bottom inner surface of the enclosed container with the compensator including a confined compressible dielectric material compatible with the dielectric oil chemically, thermally and structurally.

10 Claims, 5 Drawing Figures

ARRANGEMENT TO PREVENT CORONA DISCHARGE AND ELECTRIC RUPTURE IN HIGH VOLTAGE ELECTRICAL COMPONENTS

BACKGROUND OF THE INVENTION

The present invention relates to an arrangement to prevent corona discharge and electric rupture in high voltage electrical components such as in high voltage power supplies.

In many applications, especially in high voltage power supplies, wired electronic components are submersed in oil to prevent corona discharge or electric rupture in the circuitry. Since the containers of oil and components are usually exposed to broad limits of temperature, either environmental or operational, provisions must be made for the thermal expansion and shrinkage of the oil to prevent excessive structural loads on the container and the components. Normally, in the prior art, this is accomplished by providing cushions of air above the oil level beneath which the components are submersed. Since the pressure of this cushion of air not only increases because of compression by the encroachment of expanding oil, but also because of its own simultaneous increase in temperature, the required cushion is usually considerable to retain the resultant pressure to within the structural capabilities of the container.

Further, in shipboard equipment, the container rolls and pitches through a 90° angle which moves and reorients the air cushion within the container with respect to the components so as to expose the components to corona discharge and electric rupture.

SUMMARY OF THE INVENTION

An object of the present invention is to provide an arrangement to prevent corona discharge and electric rupture in high voltage electrical components overcoming the disadvantage of the above-mentioned prior art arrangement.

Another object of the present invention is to provide a volume/pressure compensator in an arrangement to prevent corona discharge and electric rupture in high voltage electrical components which eliminates the need for a cushion of air above the oil in the container.

A feature of the present invention is the provision of an arrangement to prevent corona discharge and electric rupture in high voltage electrical components comprising: an enclosed container containing therein the electrical components; a dielectric oil disposed in and completely filling the container; and a volume/pressure compensator fastened to an inner surface of the enclosed container, the compensator including a confined compressible material compatible with the oil chemically, thermally and structurally.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
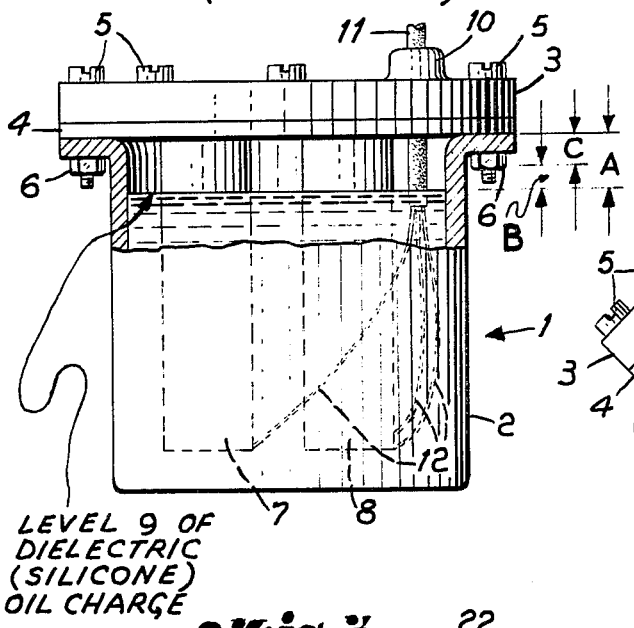
Fig. 1 (PRIOR ART)
FIGS. 1 and 2 are diagrammatic illustrations of the prior art arrangement to prevent corona discharge and electric rupture in high voltage electrical components.
Figure 2:
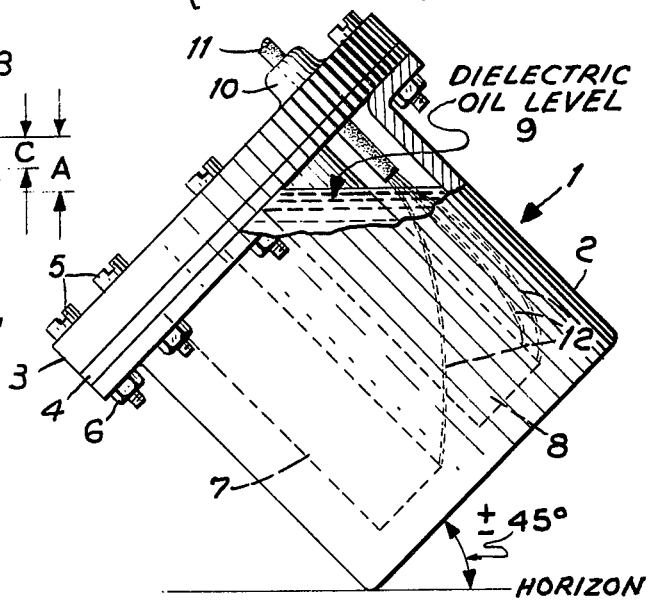
Fig. 2 (PRIOR ART)

Referring to FIGS. 1 and 2, the prior art arrangement to prevent corona discharge and electric rupture of high voltage electrical components includes an enclosed container 1 having a main container body 2 and a cover 3 which is sealed to body 2 by seal 4. Cover 3 is fastened to body 2 of the enclosed container 1 by means of bolts 5 and nuts 6. The enclosed container 1 includes the high voltage electrical components 7 and 8 subject to corona discharge and electric rupture.

Prior to placing cover 3 in an enclosed arrangement with body 2 of container 1, body 2 is partially filled to a level 9 with a dielectric oil, such as a silicone oil.

The electrical components 7 and 8 are connected to other electrical components of a system through means of a feedthrough arrangement 10 for cable 11 containing electrical leads 12 for connection to components 7 and 8.

The dimension A is the air cushion provided at room temperature and at atmospheric pressure when the components are not in operation. Dimension B represents the terminal expansion of the dielectric oil during operation of the components and dimension C is the air cushion during operation of the components. As indicated, the volume is decreased due to encroachment of expanding oil, pressure increase due to decreased volume of air cushion and to increased temperature. The resultant pressure is limited by design to the buckling strength or yield of the walls of container 1.

As mentioned hereinabove, when the container is employed in shipboard equipment, the container 1 rolls and pitches through a 90° angle which moves and reorients the air cushion within the container with respect to electrical components 7 and 8 so as to expose these components to corona discharge and electric rupture as illustrated in FIG. 2.

Figure 3:
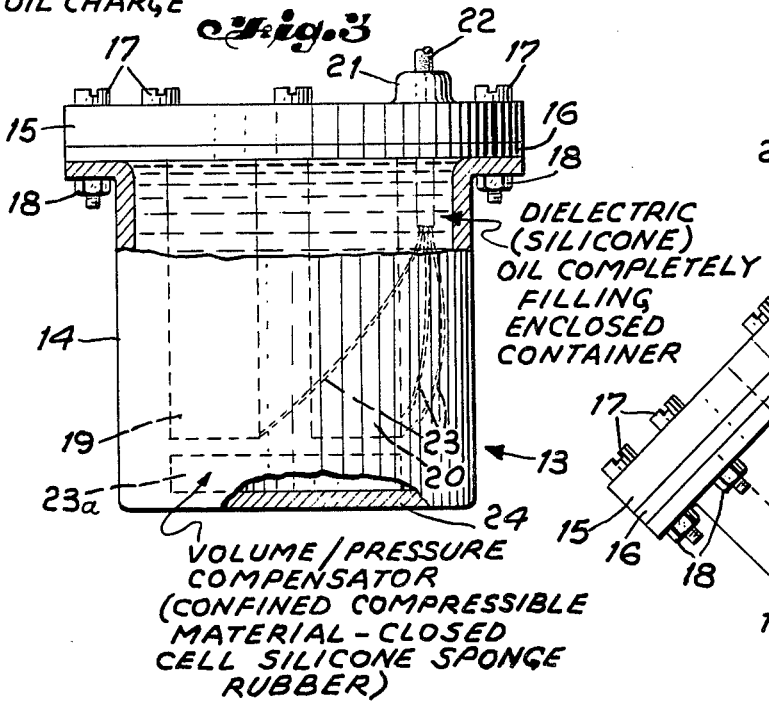
FIGS. 3 and 4 are diagrammatic illustrations of the arrangement to prevent corona discharge and electric rupture in high voltage electrical components in accordance with the principles of the present invention.
Figure 4:
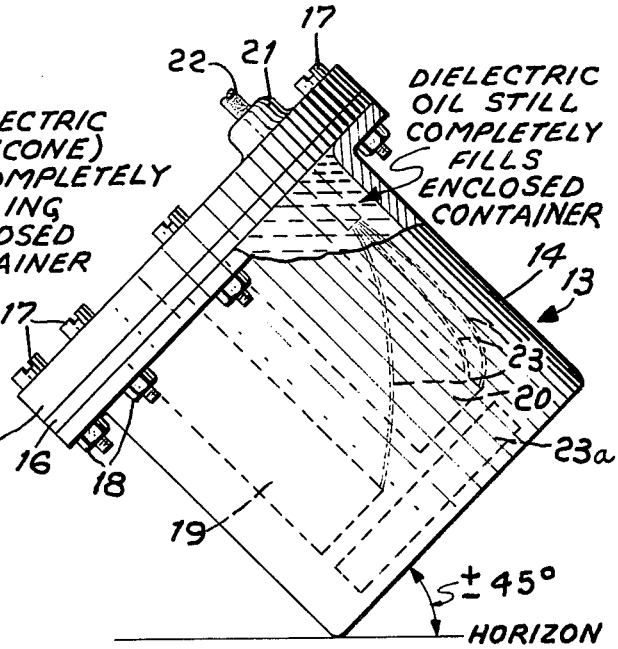

Referring to FIGS. 3 and 4, there is illustrated therein an arrangement to prevent corona discharge and electric rupture in high voltage electrical components in accordance with the principles of the present invention. The arrangement includes an enclosed container 13 having a main body 14 and a cover 15. As in the prior art arrangement, a seal 16 is provided between body 14 and cover 15 with the cover 15 being fastened to body 14 by bolts 17 and nuts 18. The container 13 includes the electrical components 19 and 20 to be protected from corona discharge and electric rupture. A feedthrough 21 in cover 15 permits entrance of a cable 22 containing electrical conductors 23 for the components 19 and 20.

Before the cover 15 is bolted to body 14, a dielectric oil, such as a silicone oil, is poured into the container 13 so as to completely fill the enclosed container 13. To compensate for volume/pressure within container 13 under operating conditions there is provided a volume/pressure compensator 23*a* which is a confined compressible material, preferably a dielectric material, such as a closed cell silicone sponge rubber. Such a silicone sponge rubber is obtainable from the Connecticut Hard Rubber Company and is designated COHRlastic R-10470.

With the silicone oil charge completely filling container 13 at room temperature, there is provided complete protection against electric rupture of the electric components. During operation of the equipment, the volume/pressure compensator 23*a* permits terminal expansion and shrinkage of the oil within the design strength of the walls of container 13. Volume/pressure compensator 23*a* is a pad of closed-cell silicone sponge rubber as mentioned above and would be fastened to the inner surface of bottom 24 of container 13 by a suitable adhesive material. The silicone sponge rubber pad of volume/pressure compensator 23*a* is compatible with the environment of the silicone oil chemically, thermally and structurally. The softness of the sponge rubber pad of compensator 23*a* is such that its compression rate conforms with the displacement requirements of the confined expanding oil without subjecting the container walls or the electrical components therein to excessive hydraulic pressure.

As illustrated specifically in FIG. 4, when the container rolls and pitches, such as in shipboard equipment, through a 90° angle, the dielectric oil still completely fills enclosed container 13 and thus the electrical components are not exposed to corona discharge and electric rupture.

Figure 5:
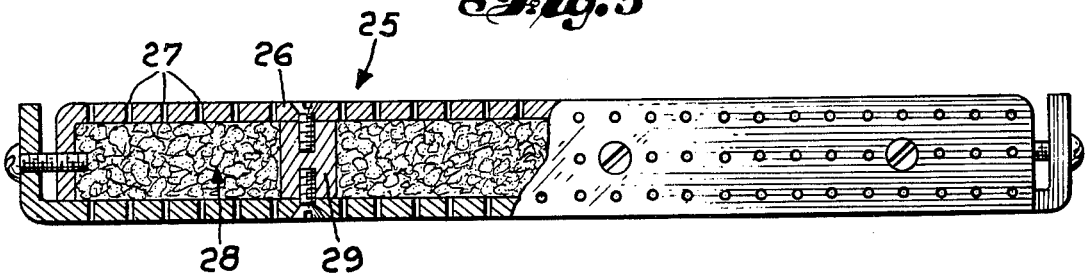
FIG. 5 is a cross-sectional view partially in elevation of a second embodiment of a volume/pressure compensator that may be substituted for the volume/pressure compensator in FIGS. 3 and 4.

Volume/pressure compensator 23*a* may take the form illustrated in FIG. 5 and can be substituted for the pad of closed cell silicone sponge rubber of FIGS. 3 and 4. As illustrated in FIG. 5, the volume/pressure compensator includes a freely-leaking container 25 having a cover 26 with perforations 27 therein so as to enable the expanding silicone oil to enter the interior of the perforated cover 26 to be acted upon by particles of closed cell silicone sponge rubber 28. The perforations 27 have a diameter that is small enough to prevent particles 28 from being sucked out of container 25. The perforated cover 26 is provided with strategically located anti-buckling posts 29. The volume/pressure compensator of FIG. 5 is normally employed where the contents of the oil filled container are evacuated to remove air entrapped in the oil and in the electrical components. With the particles 28 being encased in the freely-leaking container 25, the particles 28 are subjected to compression by hydraulic pressure, but are restrained in expansion within design limits so as to protect the closed cells of particles 28 from rupture and hence escape of air from these particles.

While we have described above the principles of our invention in connection with specific apparatus it is to be clearly understood that this description is made only by way of example and not as a limitation to the scope of our invention as set forth in the objects thereof and in the accompanying claims.

We claim:

1. An arrangement to prevent corona discharge and electric rupture in high voltage electrical components comprising:

an enclosed container containing therein said electrical components;

a dielectric oil disposed in and completely filling said container; and a volume/pressure compensator fastened to an inner surface of said enclosed container, said compensator including a confined compressible material compatible with said oil chemically, thermally and structurally;

said compensator being fastened to the bottom of said enclosed container;

said compensator including a longitudinal freely-leaking container, and said compressible material is contained in said freely-leaking container.

2. An arrangement according to claim 1, further including strategically located anti-buckling posts disposed in and along the length of said freely-leaking container.

3. An arrangement according to claim 2, wherein said compressible material includes particles of a dielectric material.

4. An arrangement according to claim 3, wherein said particles of dielectric material are particles of closed-cell silicone sponge rubber.

5. An arrangement according to claim 4, wherein said oil is a silicone oil.

6. An arrangement to prevent corona discharge and electric rupture in high voltage electrical components comprising:

an enclosed container containing therein said electrical components;

a dielectric oil disposed in and completely filling said container; and a volume/pressure compensator fastened to an inner surface of said enclosed container, said compensator including a confined compressible material compatible with said oil chemically, thermally and structurally;

said compensator including a longitudinal freely-leaking container, and said compressible material is contained in said freely-leaking container.

7. An arrangement according to claim 6, wherein strategically located anti-buckling posts disposed in and along the length of said freely-leaking container.

8. An arrangement according to claim 7, wherein said compressible material includes particles of a dielectric material.

9. An arrangement according to claim 8, wherein said particles of dielectric material are particles of closed-cell silicone sponge rubber.

10. An arrangement according to claim 9, wherein said oil is a silicone oil.

* * * * *